US006179704B1

(12) United States Patent
Suzuki

(10) Patent No.: US 6,179,704 B1
(45) Date of Patent: Jan. 30, 2001

(54) COIN DISPENSER WITH PILFERAGE DETECTION

(75) Inventor: Kazumi Suzuki, Tokyo (JP)

(73) Assignee: Asahi Seiko Co., Ltd., Tokyo (JP)

( * ) Notice: Under 35 U.S.C. 154(b), the term of this patent shall be extended for 0 days.

(21) Appl. No.: 09/298,618

(22) Filed: Apr. 23, 1999

(30) Foreign Application Priority Data

Apr. 24, 1998 (JP) ..... 10-151856

(51) Int. Cl.[7] ..... G07D 13/00; G08B 13/183

(52) U.S. Cl. ..... 453/63; 194/202; 250/221

(58) Field of Search ..... 453/17, 63; 194/200, 194/202, 203; 250/221; 340/555, 556, 557, 825.32

(56) References Cited

U.S. PATENT DOCUMENTS

| | | | | |
|---|---|---|---|---|
| 4,589,433 | | 5/1986 | Abe | 221/203 X |
| 5,281,809 | * | 1/1994 | Anderson et al. | 250/221 |
| 5,467,857 | * | 11/1995 | Takemoto | 453/17 X |
| 5,531,640 | * | 7/1996 | Inoue | 453/17 |

* cited by examiner

*Primary Examiner*—F. J. Bartuska
(74) *Attorney, Agent, or Firm*—Price and Gess

(57) ABSTRACT

A coin dispensing apparatus having a storage member for holding bulk coins that are introduced through an opening of the top of a storage member as provided with a detector assembly to determine any intrusion into the storage member. Detector assembly can create a grid pattern of radiation, such as light or infrared light that can be monitored by a computer system to determine if the object intruding into the storage base warrants the activation of an alarm.

12 Claims, 4 Drawing Sheets

START
INPUT INITIAL No. X COINS
S1
S2
IS A COIN OUTPUTTED ?
YES
NO
S3
SUBTRACT 1 FROM TOTAL COINS STORED
S6
IS A COIN INPUTTED
YES
NO
S7
ADD 1 TO TOTAL COINS STORED
S4
DO STORED COINS=0
YES
NO
S5
ISSUE EMPTY SIGNAL
S10
HAS LIGHT SENSORS BEEN INTERRUPED
NO
YES
S11
DETERMINE No. OF SENSORS ACTIVATED
S12
DOES No. OF SENSORS ACTIVATED EXCEED PREDETERMINED VALUE ?
NO
YES
S13
ISSUE ALARM SIGNAL

COIN DISPENSER WITH PILFERAGE DETECTION

BACKGROUND OF THE INVENTION

1. Field of the Invention

The present invention is directed to coin dispensing apparatus that can dispense coins or tokens from a bulk storage container, and more particularly to a security system for preventing theft.

2. Description of Related Art

Various types of coin dispensing apparatus have been used in a wide variety of machines such as amusement, gambling and product dispensing devices. The term coin is generically used to include monetary coins of various values, tokens, medallions, etc. Frequently these coin dispensers will receive an initial charge of coins in a bulk form that can be stored in a container or hopper so that the individual coins can be segregated and dispensed through a discharge chute. Additionally, such coin dispensers frequently accept coins through a delivery slot which can be added to the bulk coin supply.

U.S. Pat. No. 4,589,433 discloses an example of one type of coin dispensing apparatus. As shown in FIG. 4, a vertical supporting stand 1 mounts a rotary disc supporting plate 2. A hopper head 3 is connected to supporting plate 2 by bolts 4 to form a hopper 5 for holding a bulk supply of coins.

Mounted within the hopper 5 is a rotary disc 6 which is rotably supported on the inclined supporting plate 2. Rotary disc 6 is provided on its peripheral portion 6*a* with a plurality of coin engaging projections, such as pins 8. Concentrically overlaying the top surface of the rotary disc 2 is a central plate or disc 9 which, along with the pins 8, define a plurality of coin receiving spaces on the rotary disc 2. These coin receiving spaces pick up coins from the lower portion of the hopper 5 and deliver them to an upper delivery zone 7 for dispensing. A delivery knife 10 is secured to the supporting plate 2 so that the top surface of the knife point 10*a* is tangential to the upper periphery 9*a* of the central disc 9. Thereby coins carried by the pins 8 are transferred from the upper periphery 9*a* onto the delivery knife 10 to pass a coin into a discharge chute 11. A knife point portion 10*a* of delivery knife 10 has a thickness corresponding to the thickness of the coin being dispensed. A coin discharging rail 10*b* is inclined downwards within the discharge chute 11. Mounted above the delivery knife 10 is a counter roller 13 which is rotably supported on the free end of a spring loaded rocker arm 12. A switch is activated by a coin passing between the delivery knife 10 and the counter roller 13 to indicate a discharge of a coin. Also, in the upper delivery zone there is an antidoubling means or wiper 14 for controlling the coins passing to the discharge chute 11. The wiper 14 can be made of a sheet of elastomer material which is secured to a mount piece 16 on the supporting plate 2 together with a deflecting metal sheet 17.

On the central disc 9 are three agitating coil springs 15 which extend radially. This coil springs 15 are resiliently held at the inner end portions on the central disc 9 by an elastomer retainer 30 and a connecting piece 31. Thus, when central disc 9 rotates, the bulk coins are agitated at the lower portion of the hopper 5 to facilitate picking up the coins which are then delivered to be discharged on a one-by-one basis through the discharge chute 11.

Since the coin dispensing apparatus stores a large number of coins in a bulk condition inside the hopper 5, the opening of the hopper 5 is a relatively large area and it permits access to the coins when an outer housing or panel is opened, for example during repairs or for dislodging a coin that may have jammed in the system. Thus, technicians, operators and repair people can have access to the stored coins in bulk form in the hopper 5 during normal maintenance and repair operations, such as the charging of products in a vending machine or the servicing of an amusement or gaming device in a casino. The potential for theft exists in such an environment.

SUMMARY OF THE INVENTION

The present invention provides a coin dispensing apparatus having a storage member for receiving bulk coins, tokens, medallions, etc. through an upper opening on the storage member. The individual coins can be subsequently dispensed, for example through a computer-based control system that can maintain a count of the coins in the storage member at any particular time. A detector assembly can be operatively positioned relative to the opening of the storage member and can project a beam radiation grid, such as a plurality of light beams of visible or infrared radiation which can be used to detect any intrusion of an unwarranted object, such as a hand into the storage member.

A plurality of light emitting diodes and corresponding light sensors can be aligned across the periphery or perimeter of the opening on the storage member. The resulting plurality of light beams form a grid pattern of a predetermined size, so that if, for example, a hand is inserted into the hopper a predetermined number of sensors will be activated and the computer control system can then poll the sensors and compare the number of light beams in the grid interrupted by a hand with a predetermined stored value and if the predetermined value is matched or exceeded, an alarm device can then be activated to indicate an unauthorized intrusion into the stored coins. The alarm can be audio/visual or silent and can be integrated, for example, with the security system of an amusement or gambling establishment.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may be best understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a coin dispensing apparatus with a pilferage detection system which can operate either as a single vending or gaming machine alone that is self-contained or can be integrated into a security system of the establishment that is using the coin dispensing apparatus of the present invention.

The present invention is directed at a problem which is believed to be heretofore not addressed, that is theft of coins from a coin dispenser apparatus by personnel that can have authorized access to the coin dispensing apparatus. When a vending machine, amusement device, gaming device, etc. must be accessed by personnel with authorization to open a housing or panel member that general obscures or protects the bulk coins stored in the coin dispenser apparatus a potential for theft can occur. Thus, service people who are recharging vending machines with product and operating people that can open the machines to make minor repairs and to free a jammed coin can engage in employee theft. The present invention can provide security against such theft while accommodating the additional dropping of coins into a storage member through an opening in the storage member and without inhibiting the opening for receiving initial charges of bulk coins. For example, a gaming machine is initialized, with a certain value of bulk coins provided in the machine. Subsequently, during operation coins are discharged while other coins can be inserted by users to be added to the bulk coin supply. The present invention provides a degree of security against tampering by individuals who have access to the interior of such machines.

Figure 1:
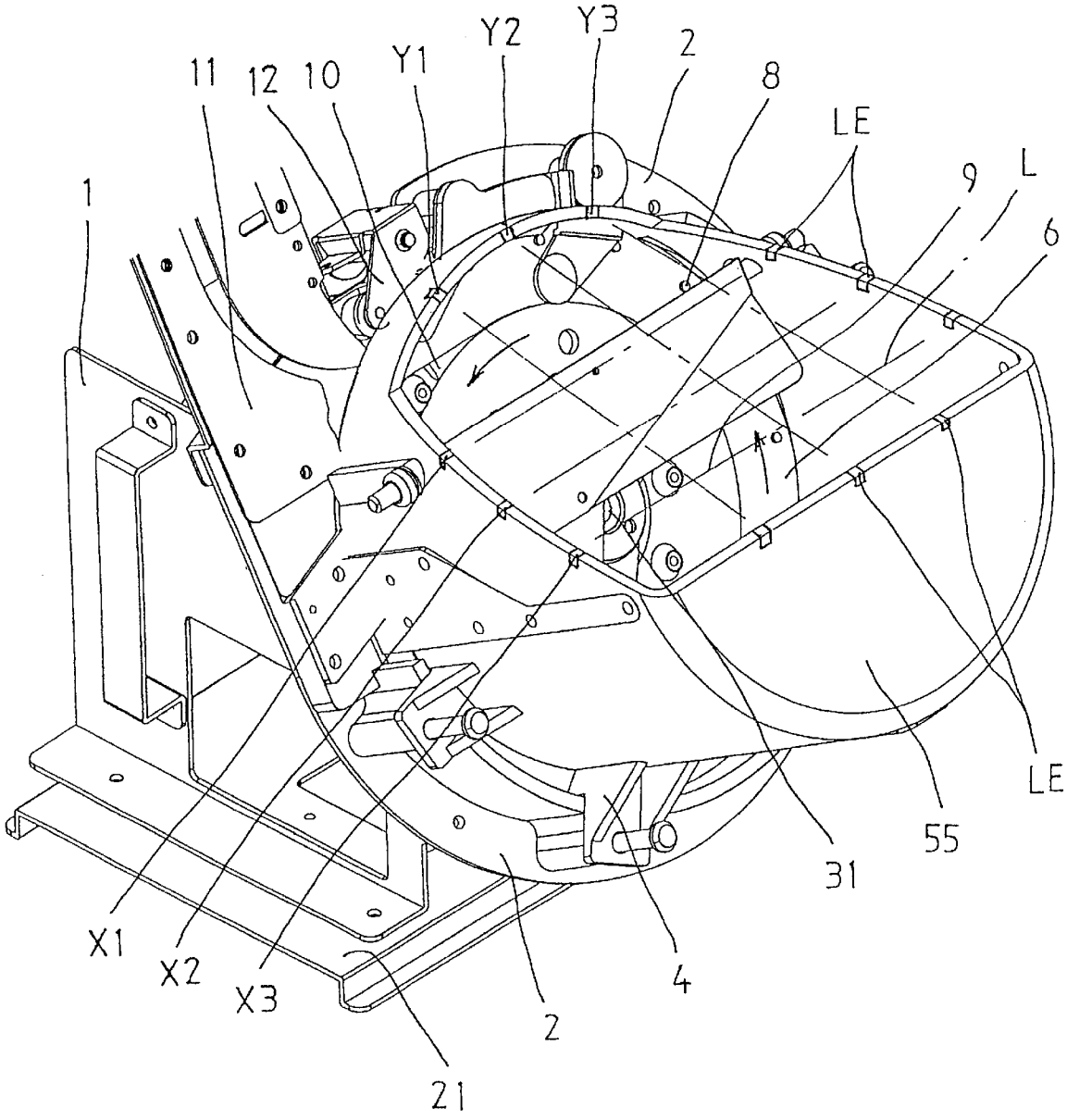
FIG. 1 is a perspective view of a coin dispensing apparatus of the present invention with a detector assembly integrated into the perimeter opening of a hopper.

Referring to FIG. 1, a pair of support structures of which one is shown in a substantially triangular shape is fixed to extend upward from a standboard 21 that has been specifically installed within a game machine or vending machine and appropriately leveled so that its rectangular surface can properly mount the frame 1. A circuiar-shaped plate or support plate 2 is fixed at an inclined condition to the respective frame members 1. Mounted on an upper surface of the support board or plate 2 is a storage tank or hopper 55 of roughly a cylinder configuration with a top half of the cylinder laid open. Tank 55 is supported by a plurality of flanges 4. Mounted within the tank 55 is a turning disc or turn board 6 that can be turned counterclockwise by an electric motor (not shown) through a transmission system (not shown) and a driving axle 31. A rotable plate member 9 can cooperate with a series of pins 8 to pick up individual coins from the bulk coins stored within the hopper or tank 55. Tangentially mounted adjacent an upper left hand position of the rotable stand member 9 in FIG. 1 is a knife member for guiding a coin that is provided at the outside upper edge of the stand part 9 so that it can be delivered to a discharge chute 11.

Thus, as the board member 6 turns counterclockwise, the loose coins in the tank 55 are picked up, one-by-one, by means of the outside edge of the stand member 9 and the pins 8. These coins are rotated upward until they are removed as a result of the interaction with the knife I 0. Adjacent to knife edge 10 is a roller arm 12 which can activate a switch (not shown) every time a coin is forwarded to the discharge chute I 1. As can be readily appreciated, the particular configuration of the hopper and coin pickup apparatus is not critical to the present invention and can be varied by persons skilled in the art.

A detector assembly is operatively positioned relative to the opening on the hopper or storage member 55 and is shown in a schematic form whereby a plurality of light sensors X1, X2, X3, Y1, Y2, and Y3 are positioned along adjacent sides of a perimeter of the opening of the storage member 55. Juxtapositioned on the other adjacent perimeter sides of the storage opening are a series of light emitters, LE, that are capable of producing directional radiation beams or light beams L as shown in FIG. 1. Both the respective sensors and light emitters are shown in schematic form and other arrangements can be contemplated by a person skilled in this field to accommodate the particular configuration of sensors and detectors utilized.

The resulting grid of light beams form a detection zone of a predetermined configuration to detect the intrusion of any object, P, such as a hand into the coin storage space of the storage member 55. While light emitting diodes for producing visible light can be utilized as light emitters, it is also possible to use infrared light so that the grid itself would not be seen by the intruder. Additionally, the actual perimeter of the opening in the storage member 55 can be designed with a shield or cover ring 70 to obscure the actual positions of the light emitting elements and light sensors without inhibiting the formation of the grid pattern.

Figure 2:
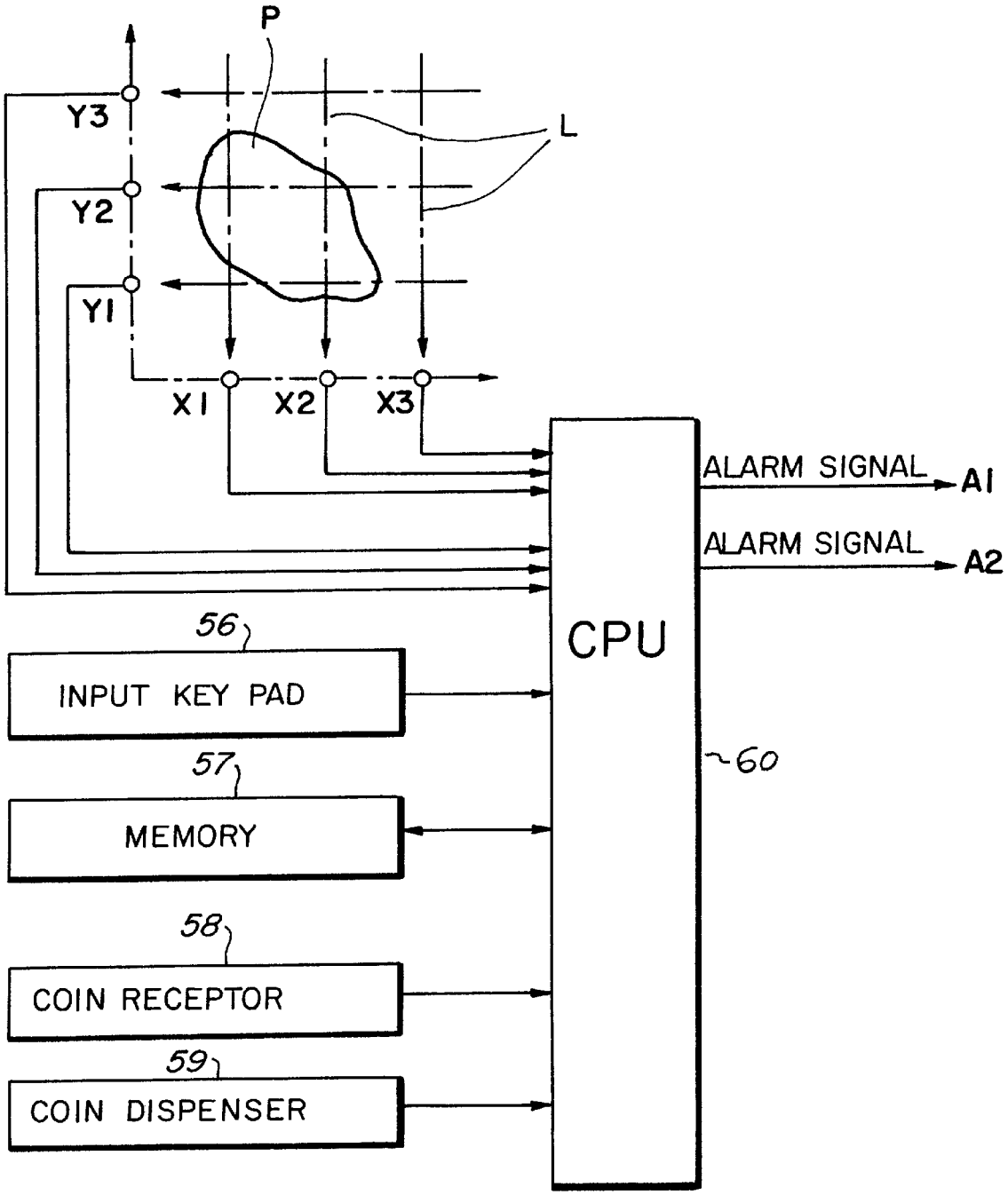
FIG. 2 is a schematic diagram disclosing the interface of the light grid pattern with a computer-based control system.

Referring to FIG. 2, a schematic of a light grid pattern formed by the light beams L, the light sensors Y1, Y2, Y3 and X1, X2, X3 and a relationship to a CPU controller circuit is shown. An object of a predetermined size which is arbitrarily shown as object P is sufficiently large to block or obscure 4 out of the 6 light sensors so that only Y3 and X3 are being impinged by the light beams. If this number, 4, is stored as the predetermined threshold point for activating the alarm system, the CPU signal processing unit, such as a microprocessor or computer unit 60 can make a comparison and activate an appropriate alarm The signal processing unit CPU 60 is further connected to a setting means 56 or input keypad that permits inputting the initial number of coins that are charged in bulk form inside the storage tank 55. Thus, the CPU 60 can store the initial number of coins when the coin dispensing apparatus is being put into service. Schematically shown as a coin receptor 58, structure is provided so that when a coin is inserted, for example by a user, the coin receptor 58 can sense and produce an output signal for each coin to the signal processing unit CPU.

If a coin is dropped through the light grid pattern, it will not block a sufficient number of light beams, if in fact it obscures any light beams across the storage tank 55. The coin receptor 58, for example, can be an electronic coin selector or mechanical coin selector as known in the art.

A coin dispenser 59 can provide an output signal whenever a coin is discharged through the discharge chute 11. Thus, a signal for each coin discharged is also provided to the single processing unit CPU 60. As shown, for example, in FIG. 1 the roller arm 12 can constitute a portion of the coin dispenser equipment 59 so that a signal is output to the signal processing unit CPU 60 every time the roller arm 12 is activated to close a switch. A memory 57 that store values, such as the initial number of coins charged into the coin dispensing apparatus and a predetermined threshold value that can be compared whenever the light sensors are polled by the CPU 60 to determine if there is an intrusion into the storage hopper 55. Thus, signals can be inputted and outputted from the working memory 57 as known in the art.

As can be seen, the respective light sensor Y1–Y3 and X1–X3 can be connected through an appropriate I/O interface to ports of the CPU 60. While not shown, the CPU 60 can also control the generation of the light grid pattern which can be either continuous or intermittent on a predetermined clock cycle. The CPU 60 can also output an alarm signal, A1, indicating for example that the storage tank 55 is empty and an alarm signal, A2, indicating that there has been an intrusion by an object, such as a hand, through the light grid pattern.

In operation, the initial value of the bulk loose coins that have been charged into the storage hopper 55 can be entered, for example, by input keypad 56 into the CPU 60. This value can be appropriately stored at an appropriate address in the memory 57. Subsequently, as coins are dispensed, the coin dispenser 59 can register the number of coins dispensed which can be subtracted from the initial charge of coins. Also, a coin receptor 58 can sense any coins added to the storage hopper 55, for example, as a result of use by users playing a game machine or purchasing a product from a vending machine and thereby adding coins to the storage hopper 55. The count of the added coins can be added so that a running count of the actual number of coins within the storage hopper 55 can be maintained in the memory 57.

Figure 3:
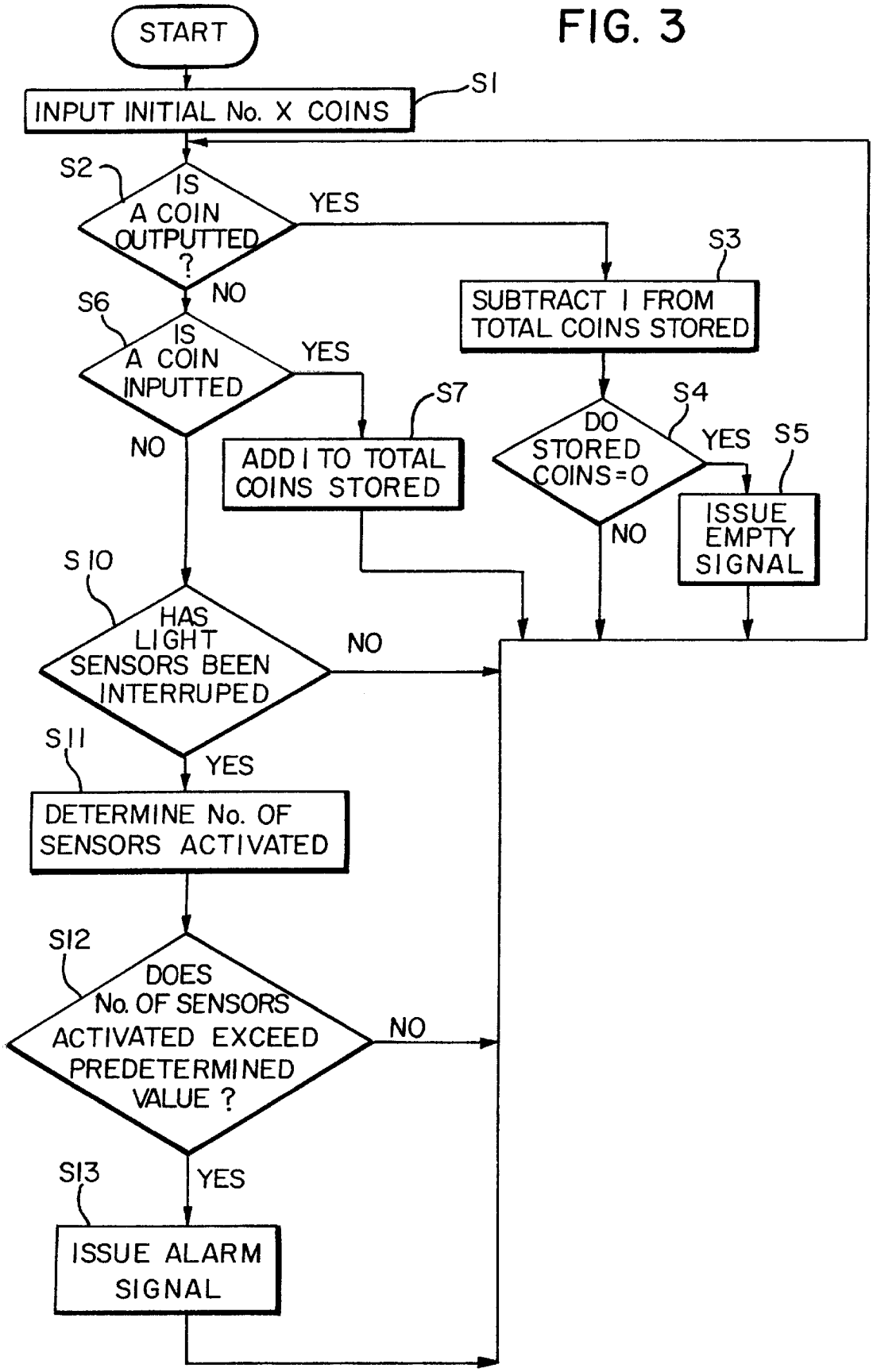
FIG. 3 is a flow diagram to explain one possible operation of the embodiment of FIG. 2.
Figure 4:
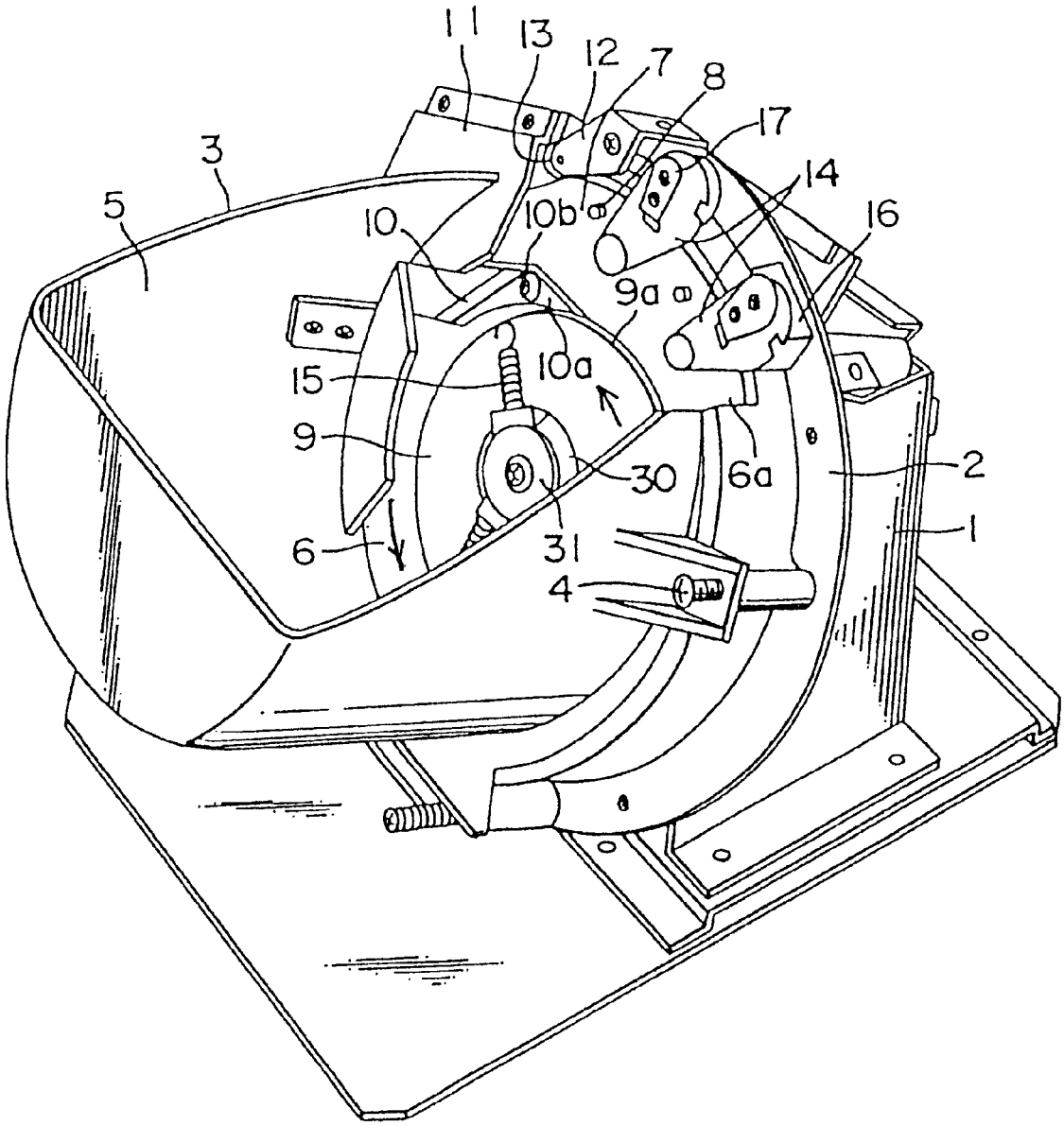
FIG. 4 is a perspective view of a prior art coin dispensing structure.

Referring to FIG. 3, a schematic flow chart is shown representing one method of operation of the computer controller system The system is a initiated with a start step that can include various initiation routines to determine that the coin dispensing apparatus is operable. At S1, the initial charged number of coins X, can be determined, for example, by operation of a conventional keypad 56 or other means for entering the initial charge of coins. At step S2, a decision is made as to whether a coin has been output from the discharge chute 11 by polling a flag that can be set by the coin dispenser 59. If no coin has been output, the program continues to the step S6. If, however, a coin has been output, that coin is subtracted from the total number of coins that are stored at that time in the machine at step S3. After step S3, a decision is made as to whether the stored coins have been reduced to 0 or another minimum number. This is done by making a comparison of a stored total number of coins in the memory 57. If the answer is YES, then an empty signal can be issued in step S5. If the answer is NO, the process returns to again loop through the above cycle.

If a coin has not been outputted in step S2, the program continues to step S6 where it is determined if a coin has been inputted to the hopper 55. If the answer is YES, this coin is then added to the total number of coins stored in step S7 and again the program loops back to monitor any flag set by the coin receptor 58 and coin dispenser 59. If a coin has not been inputted into the system, the CPU 60 then polls the respective light sensors Y1–Y3 and X1–X3 to determine if any of these light sensors have been interrupted by an object such as the object, P, shown in FIG. 2. If the answer is NO, the program then loops back to repeat the above steps. If the answer is YES, then in step S11, there is a determination made of the number of sensors that have been activated. In step S12, a decision is made as to whether the number of sensors activated exceed a predetermined stored value which determines a threshold for initiating an alarm signal S2. If the answer is NO, again the program loops back to repeat the earlier steps. When the answer is YES, then in step S13, an alarm signal is issued such as the alarm signal A2. Also, in the flow chart of FIG. 3, an alarm signal A1 indicating an empty state for the coin dispensing apparatus is issued.

As can be readily appreciated, the particular alarm signals A1 and A2 can be customized to a particular security system in which the coin dispensing apparatus forms a part. For example, if there are a number of coin dispensing apparatus, such as slot machines in a casino, an empty signal, A1, can indicate an empty notice on the actual slot machine and/or can inactivate the reception of any additional coins. Additionally, an empty signal can be integrated into a central control room through the CPU 60. Additionally, the security system of the present invention can be integrated into a casino security system so that the alarm signal A2 can either be visual and audio at the site of the coin dispensing apparatus and/or can be a silent signal to a control position so that both human monitoring and video camera monitoring can occur to determine the identity of the intruder.

While the preferred embodiment is shown with a plurality of light emitters, it is possible that as an alternative embodiment a single light source can be then subdivided through prisms, optical lenses or even a rotating scanner as long as an effective light grid pattern is maintained across the opening of the storage hopper 55 for a time duration that would prevent the intrusion of an object of a predetermined size, such as a size of a human hand.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. In a coin dispensing apparatus having a storage member for receiving bulk coins through an opening on the storage member so that individual coins can be dispensed, the improvement comprising:

a detector assembly having a plurality of sensor units operatively positioned adjacent to the opening on the storage member and above a level for storing coins in the storage member to detect an intrusion of an object larger than a coin into the storage member when two or more of the plurality of the sensor units are activated.

2. The apparatus of claim 1 wherein the detector assembly includes a beam of radiation extending a cross the opening.

3. The apparatus of claim 1 wherein the detector assembly includes a plurality of beams of radiation extending across the opening.

4. The apparatus of claim 3 where the plurality of beams form a grid pattern.

5. The apparatus of claim 4 further including a computer system for monitoring the grid pattern and storing a predetermined valve to compare the number of beams in the grid pattern interrupted by an object and an alarm device for providing an alarm when the predetermined value is matched or exceeded.

6. The apparatus of claim 5 wherein the beams of radiation are formed by a plurality of light emitting semiconductors mounted on an edge of the opening.

7. The apparatus of claim 1 wherein the storage member has a perimeter extending about the opening and the detector assembly includes a plurality of light emitting devices and light receiving sensors forming the plurality of sensor units mounted about the perimeter to form a grid pattern of light extending from a respective light emitting device to a respective light receiving sensor.

8. A coin dispenser apparatus comprising:

a coin storage tank having a cylinder configuration with an open top for storing bulk coins to a predetermined storage level in the tank;

dispensing means mounted within the tank for dispensing individual coins from the coin storage tank;

a plurality of light emitters positioned along an edge of the open top above the predetermined storage level for providing a light grid pattern above the predetermined storage level of coins in the coin storage tank;

a plurality of complementary light sensors positioned along the edge of the open top for sensing the light grid pattern above the storage level of coins in the coin storage tank; and an alarm unit connected to the light sensors for activating an alarm signal when a predetermined plurality of light sensors indicate an object blocking the light path of corresponding light emitters in the light grid pattern.

9. The apparatus of claim 8, wherein the light grid pattern forms a series of crossing light beams with spacers therebetween smaller than a hand.

10. The apparatus of claim 9, wherein the alarm unit includes a computer system for monitoring the light grid pattern, the computer system stores a predetermined value to compare the number of light beams in the grid pattern interrupted by the object so that the alarm signal is activated when the predetermined value is matched or exceeded.

11. The apparatus of claim 10, wherein the grid pattern is formed of infrared light.

12. The apparatus of claim 11, further including a cover ring to obscure the position of the light emitters and light sensors along the open top.

* * * * *